US007215899B2

(12) United States Patent
Kimizuka et al.

(10) Patent No.: US 7,215,899 B2
(45) Date of Patent: May 8, 2007

(54) IMAGE FORMING APPARATUS HAVING TEMPERATURE SENSING ELEMENT FOR SENSING TEMPERATURE OF RECORDING MATERIAL

(75) Inventors: Eiichiro Kimizuka, Mishima (JP); Yutaka Kubochi, Mishima (JP); Fumiki Inui, Mishima (JP); Eiji Uekawa, Mishima (JP); Akihito Kanamori, Numazu (JP); Satoru Izawa, Suntoh-Gun (JP); Masataka Mochiduki, Suntoh-Gun (JP); Toshihiko Ochiai, Tokyo (JP); Koji Nihonyanagi, Susono (JP); Shinji Hashiguchi, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 49 days.

(21) Appl. No.: 11/062,634

(22) Filed: Feb. 23, 2005

(65) Prior Publication Data

US 2005/0191075 A1 Sep. 1, 2005

(30) Foreign Application Priority Data

Feb. 27, 2004 (JP) ..... 2004-054638
Apr. 9, 2004 (JP) ..... 2004-115596

(51) Int. Cl.
*G03G 15/20* (2006.01)

(52) U.S. Cl. ..... 399/69; 399/44; 399/68

(58) Field of Classification Search ..... 399/44, 399/67, 68, 69, 320, 322, 328
See application file for complete search history.

(56) References Cited

U.S. PATENT DOCUMENTS 5,543,904 A 8/1996 Kato et al. ..... 355/285
5,860,051 A 1/1999 Goto et al. ..... 399/529
5,862,435 A 1/1999 Suzumi et al. ..... 399/68
5,920,757 A 7/1999 Izawa et al. ..... 399/329
5,960,233 A 9/1999 Goto et al. ..... 399/69
6,298,213 B1 10/2001 Miyamoto et al. ..... 399/320
6,493,521 B2 12/2002 Miyamoto et al. ..... 399/44
6,519,426 B2 2/2003 Goto et al. ..... 399/69
6,671,488 B2 12/2003 Izawa et al. ..... 399/329
6,701,102 B2 3/2004 Hasegawa et al. ..... 399/69
6,713,725 B2 3/2004 Izawa et al. ..... 219/216
6,763,205 B2 7/2004 Izawa et al. ..... 399/69
6,862,416 B2 3/2005 Hashiguchi et al. ..... 399/69
6,895,207 B2 5/2005 Kataoka et al. ..... 399/328
6,915,099 B2 7/2005 Izawa et al. ..... 399/328
2005/0163523 A1 7/2005 Omata et al. ..... 399/69
2005/0169656 A1 8/2005 Nihonyanagi et al. ..... 399/69
2005/0191070 A1 9/2005 Izawa et al. ..... 399/44

(Continued)

FOREIGN PATENT DOCUMENTS

JP 1-150185 6/1989

(Continued)

*Primary Examiner*—Hoang Ngo
(74) *Attorney, Agent, or Firm*—Fitzpatrick, Cella, Harper & Scinto

(57) ABSTRACT

According to the present invention, a temperature sensing part of temperature sensing means is arranged to come into contact with the surface opposite to the image surface of a recording material at the time of one-sided printing without providing such an opposed member that comes into contact with the image surface of the recording material at least in a position corresponding to the position of the temperature sensing part that is in contact with the recording material.

16 Claims, 19 Drawing Sheets

FOREIGN PATENT DOCUMENTS

| | | |
|---|---|---|
| JP | 1-160473 | 6/1989 |
| JP | 3-53276 | 3/1991 |
| JP | 4-181250 | 6/1992 |
| JP | 6-308854 | 11/1994 |
| JP | 7-230231 | 8/1995 |
| JP | 7-239647 | 9/1995 |
| JP | 10-161468 | 6/1998 |
| JP | 2000-66461 | 3/2000 |
| JP | 2001-13816 | 1/2001 |
| JP | 2002-23555 | 1/2002 |
| JP | 2002-214961 | 7/2002 |
| JP | 2003-29485 | 1/2003 |

IMAGE FORMING APPARATUS HAVING TEMPERATURE SENSING ELEMENT FOR SENSING TEMPERATURE OF RECORDING MATERIAL

BACKGROUND OF THE INVENTION

1. Field of the Invention

The present invention relates to an image forming apparatus such as a copying machine or printer using electrophotography or electrostatic recording. In particular, it relates to an image forming apparatus having temperature sensing means for sensing the temperature of a recording material after fusing.

2. Description of the Related Art

An image forming apparatus, such as a copying machine or printer, using electrophotography or electrostatic recording is provided with a fuser for heat-fixing or fusing a toner image onto a recording material. In this case, various techniques are employed to increase the fixability of the image.

One of such techniques, there is proposed a technique for sensing the temperature of a recording material after fusing, and feeding it back so that it will be brought close to a control target temperature. For example, see Japanese patent application laid-open No. H01-150185 (1989), Japanese patent utility model laid-open No. H01-160473 (1989), and Japanese patent application laid-open Nos. H03-53276 (1991), H04-181250 (1992), H06-308854 (1994), H07-230231 (1995), H07-239647 (1995), H10-161468 (1998), 2000-66461, 2001-13816, 2002-23555, 2002-214961, and 2003-29485.

For example, FIG. 9 shows an example of a fusing device using a non-contact sensor for sensing the temperature of a recording material after fusing. In such a fusing device, a non-contact sensor 20 such as an infrared sensor is placed downstream of a fixing area or nip so that it measures the temperature of the recording material in a non-contact manner.

FIG. 10 shows an example of a fusing device using a contact type sensor for sensing the temperature of a recording material after fusing. In such a fusing device, a temperature sensor 18 such as a thermistor is placed downstream of a fixing nip, and an opposed member 19 such as a rubber roller is placed to face the temperature sensor, so that the recording material is nipped between the temperature sensor and the opposed member, allowing the temperature sensor to measure the temperature of the recording material.

In the structure for sensing the temperature of the recording material to feed back the sensed temperature, temperature sensing accuracy is crucial.

Upon fusing the recording material, since the moisture contained in the recording material is also heated, water vapor is produced from the surface of the recording material. In the case of temperature detection using the non-contact sensor, the water vapor fogs the surface of the non-contact sensor, and this makes it difficult to detect the temperature of the recording material accurately.

On the other hand, in the method of bringing the opposed member into contact with the temperature sensor so that the temperature sensor can detect the temperature of the recording material nipped between the temperature sensor and the opposed member, the opposed member draws heat from the recording material, and this also make it difficult to detect the temperature of the recording material accurately.

SUMMARY OF THE INVENTION

The present invention has been made in view of the above-mentioned problems, and it is an object thereof to provide an image forming apparatus capable of setting fixing conditions irrespective of the kind of recording material.

It is another object of the present invention to provide an image forming apparatus having a high degree of accuracy of temperature sensing of a recording material.

It is still another object of the present invention to provide a heating device for an image forming apparatus.

An image forming apparatus according to the present invention includes image forming means for forming an image on a recording material, fusing means having a fixing nip area for nipping and conveying the recording material and provided for fusing an image onto the recording material, and temperature sensing means for sensing the temperature of the recording material on the downstream side of the fixing nip area in the moving direction of the recording material. In this structure, a temperature sensing part of the temperature sensing means is arranged to come into contact with the side opposite to the image side of the recording material at the time of one-sided printing without providing such an opposed member that comes into contact with the image side of the recording material at least in a position corresponding to the position of the temperature sensing part when the temperature sensing part is in contact with the recording material.

Further objects of the present invention will become more clearly apparent when the following description is read in conjunction with the accompanying drawings.

DESCRIPTION OF THE EMBODIMENTS (First Embodiment)

Figure 8:
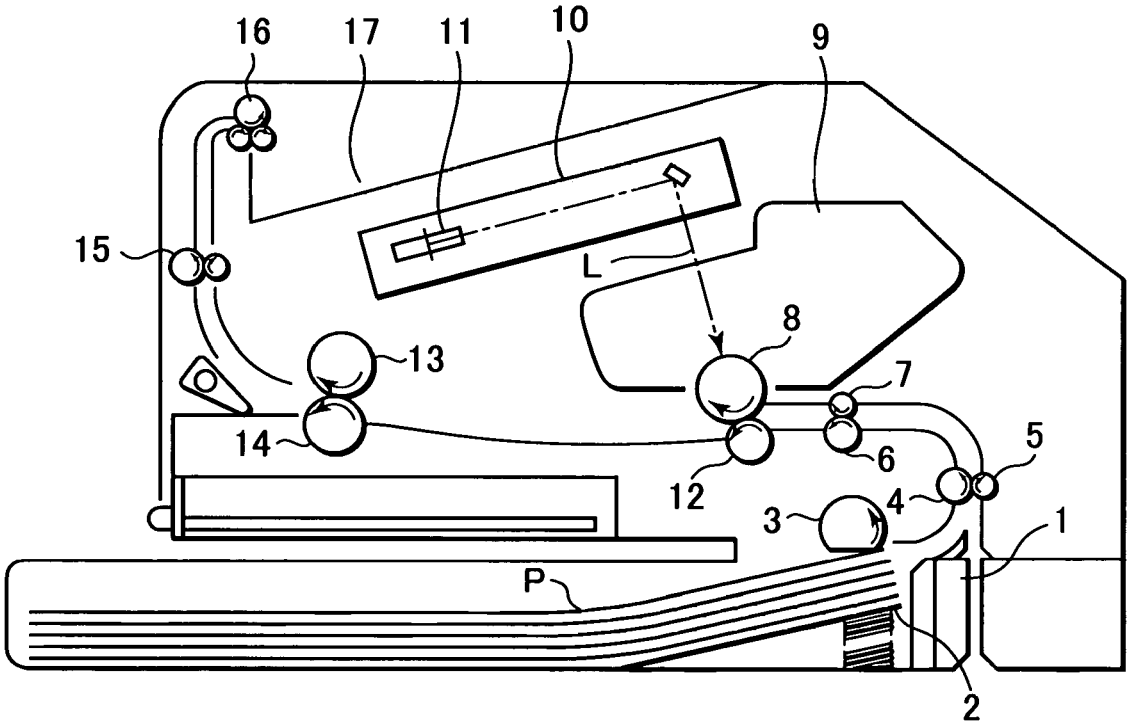
FIG. 8 is a cross sectional view of an electrophotographic printer as an example of an image forming apparatus according to the present invention.
Figure 9:
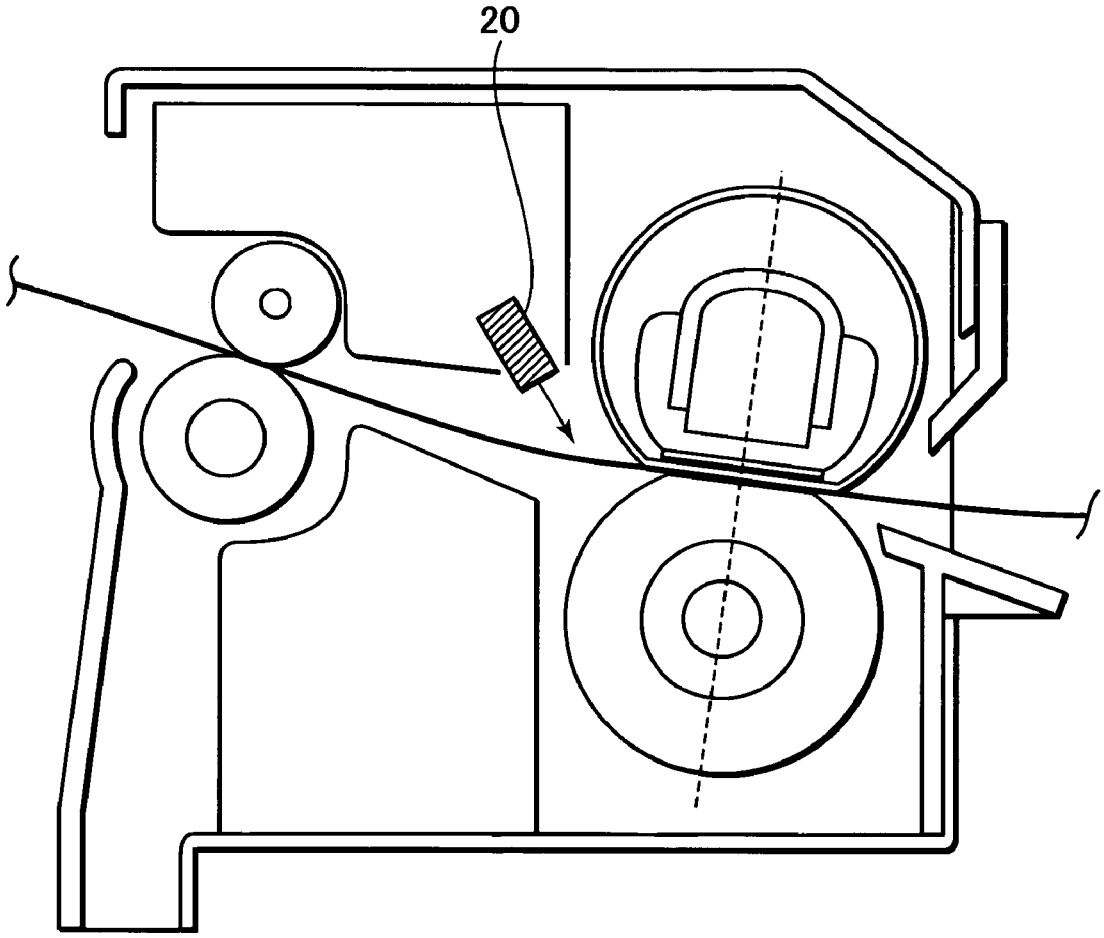
FIG. 9 is a cross sectional view showing a conventional technique for sensing the temperature of a recording material using a non-contact temperature sensor.
Figure 10:
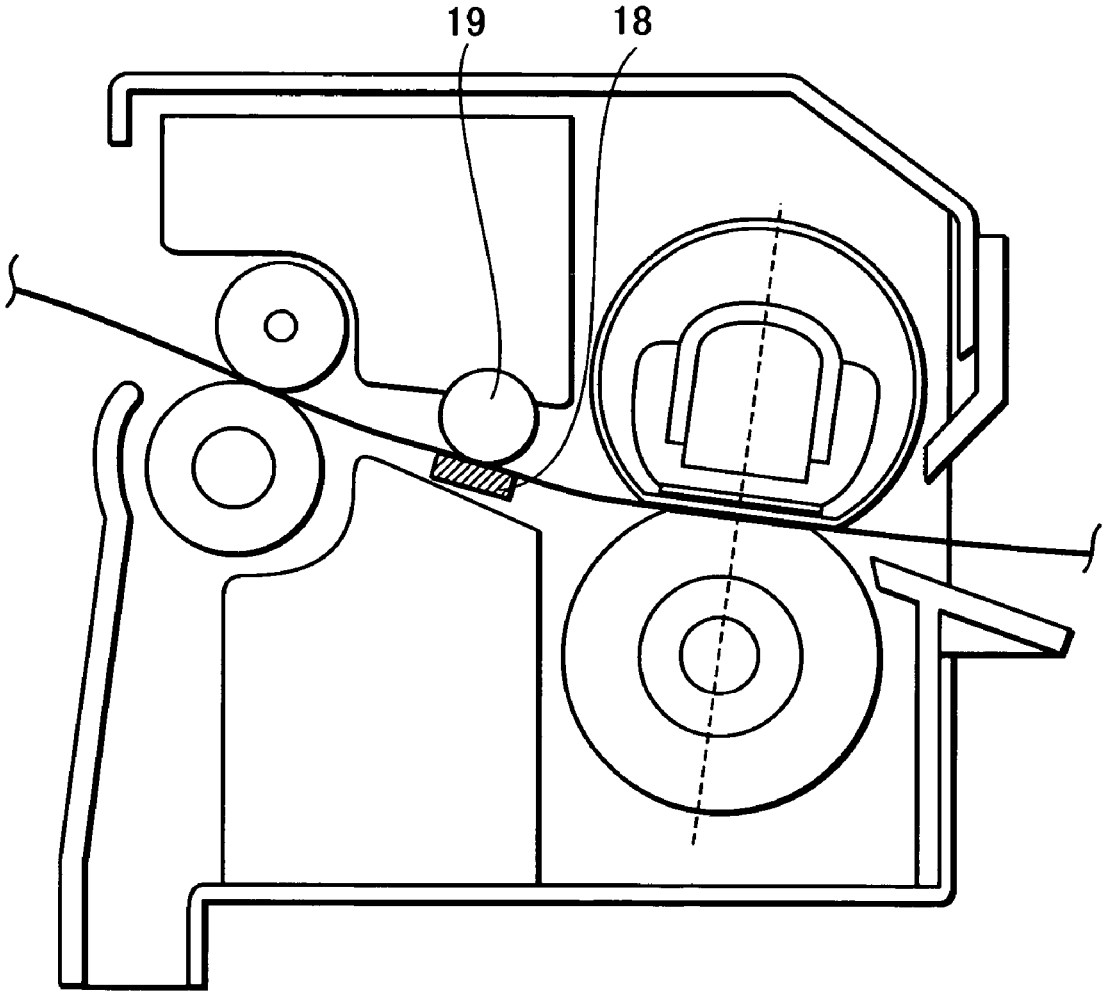
FIG. 10 is a cross sectional view showing another conventional technique for sensing the temperature of a recording material nipped between a temperature sensor and an opposed roller.

FIG. 8 is a schematic cross-sectional view of an electrophotographic printer as an example of an image forming apparatus to which the present invention is applied.

This printer is provided with a sheet feeding device consisting predominantly of a paper tray 1, a sheet stacker 2, and a feed roller 3. In operation, sheets of recording material P are stacked on the sheet stacker 2 in the paper tray 1, picked up by the feed roller 3 one by one from top to bottom, and fed by conveyance rollers 4, 5 into a resist section. The recording material is jogged in the resist section consisting of resist rollers 6, 7 to correct its conveyance direction, and fed into an image forming section (image forming means).

In the image forming section, a photosensitive drum 8, a charger (not shown) arranged around the photosensitive drum 8, a developing unit (not shown) for developing with toner a latent image formed on the photosensitive drum, and a cleaning unit (not shown) for removing toner remaining on the photosensitive drum are integrated into a toner cartridge 9 removable from the printer main body. A laser scanner unit 10 for writing an image onto the photosensitive drum 8 according to image information contains a laser light source (not shown), a laser deflecting mirror (polygon mirror) 11, a motor for driving the deflecting mirror to rotate (not shown), etc.

When the image information is inputted, the printer scans with laser light L the surface of the photosensitive drum 8 charged to a predetermined potential by the charger to form an electrostatic latent image on the photosensitive drum 8. The latent image is developed with toner as developer by development means, and the developed toner image is transferred by a transfer roller 12 from the photosensitive drum 8 to the recording material.

The recording material on which the toner image has been transferred is fed into fusing means having a heating unit 13 and a backup unit 14, and the toner image on the recording material is fused. After that, the recording material is ejected to an output tray 17 through a delivery unit composed of an intermediate delivery roller 15, a delivery roller 16, etc.

Figure 1:
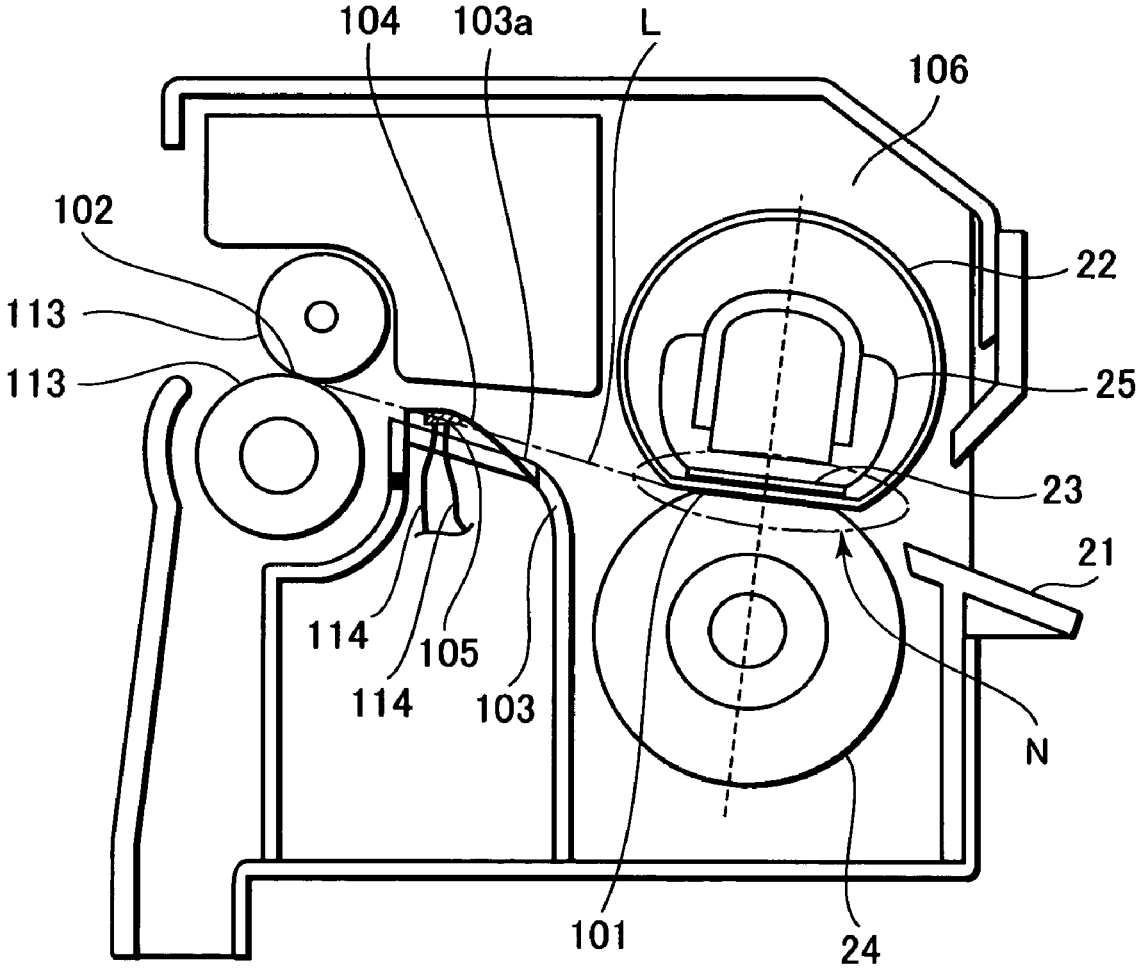
FIG. 1 is a cross sectional view showing components in the vicinity of a temperature sensing part for a recording material according to a first embodiment of the present invention.

FIG. 1 is a cross sectional view showing components in the vicinity of a fusing device and temperature sensing means for sensing the temperature of a recording material after fusing.

The printer of the embodiment is provided with a fusing device (on-demand fixing device) of a film heating type for heating paper through a film- or belt-shaped flexible sleeve (hereafter called the fixing film). However, the present invention is not limited to the image forming apparatus provided with such an on-demand fixing device. It is also applicable to an image forming apparatus provided with any other one of various fusing devices, such as a fusing device of a heat roller type in which paper is heated while being nipped and fed between a heating roller, controlled to maintain constant temperature, and a pressure roller having an elastic body layer and pressed against the heating roller.

As mentioned above, after the toner image formed in the image forming section is transferred onto the recording material, the recording material is fed into a fusing section. The fusing section consists predominantly of the heating unit 13 and the backup unit 14. The front edge of the recording material is led through an entrance guide 21 to a pressure nip area (fixing nip area) N formed between the heating unit and the backup unit.

The heating unit 13 consists predominantly of a fixing film 22, a heater (heating body) 23 brought into contact with the inner surface of the fixing film, a film guide member 25 holding the heater 23 while guiding the fixing film, and a metal stay for pressing the film guide member on the backup unit. The backup unit consists predominantly of a pressure roller 24. When the end of the metal stay is forced onto the pressure roller by means of a coil spring or the like, pressure is exerted on the fixing nip area N.

A release layer is formed around the surface of the fixing film 22. The fixing film is loosely fitted around the film guide member 25 having roughly a semicircular shape in cross-section.

The fixing film 22 preferably has a low heat capacity in order to enhance quick-start performance. For example, it is a heat-resistant resin film of 100 μm thick or less, preferably in the range between 20 μm and 60 μm, with a polyimide or PEEK base layer. Alternatively, it may be a metal film of a stainless steel or the like with a nickel electroformed base layer. Since the metal film has excellent thermal conductivity, it is enough for outstanding quick-start performance that the thickness is 150 μm or less.

The heating body 23 may be a ceramic heater made up of a heat resistor (resistor pattern) formed on a ceramic substrate as a heat source, which is supplied with power to generate heat. When power is applied through the resistor pattern, the resistor pattern generates heat and the temperature of the heater rises. This heating body is made up in such a manner that a paste resistor, made of silver and palladium, is formed by thick film printing on a substrate of alumina (aluminum 203) or aluminum nitride (AlN) to form the resistor pattern with desired resistance. A glass layer is further formed on the resistor pattern. The glass layer serves not only to protect the resistor pattern, but also as a sliding layer being in friction with the inner surface of the fixing film. A thermistor as a temperature sensing element is bonded on the backside of the resistor pattern of the substrate. The thermistor monitors temperature and input temperature information into a control circuit section (not shown). The control circuit section controls an Ac driver to control the amount of power from an AC power supply to the heating body (resistor pattern) so that the temperature sensed by the thermistor will maintain a set temperature.

The pressure roller 24 has an elastic layer of silicone rubber around a metal core made of iron or aluminum, and a PFA tube layer as a release layer around the elastic layer. The pressure roller is driven by a driving motor, not shown.

The fixing film 22 receives a driving force from the pressure roller 24 to rotate in a clockwise direction in FIG. 1 according to the rotation of the pressure roller. The recording material carrying an unfixed toner image is nipped and fed in the fixing nip area N between the heating body 23 and the pressure roller 24 through the fixing film 22. The toner image is fused onto the recording material as it passes through the fixing nip area N.

In other words, when the recording material passes through the fixing nip area N, thermal energy is transferred from the heating body to the recording material through the fixing film, so that the unfixed toner image on the recording material is fused and fixed. The recording material P that has passed through the fixing nip area N and been separated from the fixing film is then fed to a delivery section by a delivery roller pair (conveyance means) 113.

The image forming apparatus of the embodiment has only a single-sided printing function. However, regardless of whether the image forming apparatus has a double-sided or single-sided printing function, the temperature sensing part of the temperature sensing means of the present invention is placed to contact the side (non-printed side) opposite to the printed side of the recording material in the single-sided printing mode so that the temperature sensing part will contact the recording material in an interval between the fixing nip area and conveyance means closest to the fixing nip area in the downstream side of the moving direction of the recording material. The conveyance means is driven by a drive source.

There are two advantages of detecting temperature on the non-printed side of the recording material. One advantage is that a heat transmit plate (hereinafter called a "heat collector plate") resists the adhesion of toner because the recording material contacts the heat collector plate on the backside of the toner fixed surface at the time of normal one-sided printing. In other words, there is no danger of reducing temperature sensing accuracy due to adhesion of toner onto the heat collector plate. The other advantage is that the kind of recording material can be estimated from the sensed temperature, that is, from a difference in heat conductivity from the printed side to the non-printed side according to the kind of recording material, because thermal energy is transferred from the printed side and the temperature is sensed on the non-printed side. For example, the temperature on the non-printed side of a thin recording material is higher than that of a thick recording material. Therefore, it can be determined from the difference in temperature that the recording material is of a thin type when the sensed temperature is higher than a reference temperature, and that the recording material is of a thick type when the sensed temperature is lower than a reference temperature. This method of sensing the temperature of a recording material is particularly effective in the structure of a fuser having a heating element only on one side (print side in the embodiment) of the recording material, that is, no heating element on the other side (non-printed side) in this case.

(Structure of Temperature Sensing Means)

In FIG. 1, a fixing/delivery guide (recording material guiding member) 103 that forms part of the conveyance path for the recording material is provided between the fixing nip area N and a nip area 102 formed between the delivery roller pair (conveyance means closest to the fixing nip area N). One of the delivery roller pair is driven by a motor, not shown. The fixing/delivery guide 103 is made of a material having high heat resistance such as PBT or PET. A conveyance side 103*a* of the fixing/delivery guide 103 is arranged below a virtual line L connecting an end 101 of the fixing nip area N on the downstream side of the moving direction of the recording material and the nip area 102 between the delivery roller pair. The conveyance speed of the recording material between the delivery roller pair is set higher than that in the fixing nip area. In other words, when the recording material is conveyed while being nipped in both the fixing nip area N and the delivery roller nip area 102, the recording material travels in this section approximately along the straight line L connecting both nips.

A heat collector plate 104 made from a thin aluminum or stainless steel plate of about 0.1 mm thick and having low heat capacity is fixed on part of the conveyance side of the fixing/delivery guide 103 along the direction perpendicular to the conveyance direction of the recording material (that is, along the width of the recording material). At least part of the heat collector plate 104 projects from the virtual straight line L so that the projecting part (temperature sensing part) will come into direct contact with the recording material when the recording material passes through the part. In other words, the temperature sensing part is located on the opposite side of the recording material guiding member relative to the virtual straight line connecting the fixing nip area N and the nip area 102 of the conveyance means. Thus, since the heat collector plate 104 has low heat capacity and is brought into direct contact with the recording material, the temperature of the heat collector plate 104 can be made almost equal to the temperature of the recording material in a short time.

A highly responsive temperature sensor 105 such as a thermistor is fixed on the backside of the heat collector plate 104, for example, by adhesive bonding. As also shown in FIG. 1, there is no member (opposed member) contacting the recording material in an area above heat collector plate 104, that is, in an area corresponding to at least the temperature sensing part above the printed side of the recording material that is in direct contact with the temperature sensing part of the heat collector plate 104. When the recording material after fusing is conveyed from a fusing device 106, the non-printed side of the recording material comes into contact with the heat collector plate 104, causing the heat collector plate 104 to draw heat from the recording material. The heat is conducted into and sensed by the temperature sensor 105 on the backside of the heat collector plate 104, thus detecting the temperature of the recording material. In this case, since the temperature sensor 105 is mounted directly underneath the position (temperature sensing part) in which the heat collector plate 104 contacts the recording material, the influence of the temperature gradient in the heat collector plate 104 can be minimized to create such a temperature sensing state that is nearly equivalent to the case where the temperature sensor comes into direct contact with the recording material, thus increasing temperature sensing accuracy. Further, since there is no member (opposed member) contacting the recording material in an area corresponding to at least the temperature sensing part above the printed side of the recording material that is in direct contact with the temperature sensing part of the heat collector plate 104, the heat accumulated in the recording material is difficult to escape except to the heat collector plate 104, thus achieving high temperature sensing accuracy. The structure in which there is no member (opposed member) contacting the recording material in an area corresponding to at least the temperature sensing part above the printed side of the recording material that is in direct contact with the temperature sensing part of the heat collector plate 104 is common to all other embodiments to be described later. In addition, the use of the metal material for the slide member (heat collector plate) over which the recording material slides makes it possible to prevent the slide member from being worn away, and hence to improve durability.

The temperature sensor 105 is an element, typified by the thermistor, which varies its resistance with temperature; it is encapsulated in glass in such a state that dumet wires are thermally bonded to a thermistor chip to connect electrodes. The other ends of the dumet wires are connected to a control circuit section (not shown) so that temperature information detected by the thermistor will be transmitted to the control circuit section. For example, based on the sensed temperature information, the image forming apparatus sets the control temperature of the heater to the optimum temperature for the kind of the recording material.

In order to reduce the heat capacity of the heat collector plate 104, it is preferable to minimize the dimensions of the heat collector plate 104 both in the conveyance direction of the recording material and in a direction orthogonal to the conveyance direction and nearly parallel to the width of the recording material. Further, in the embodiment, since the metal heat collector plate 104 with low heat capacity is provided inside the fixing/delivery guide 103 made of plastic having low thermal conductivity, not only can the heat capacity be reduced, but also the thermal insulation can be increased, thereby increasing the responsiveness of the temperature sensor 105.

(Second Embodiment)

Figure 2:
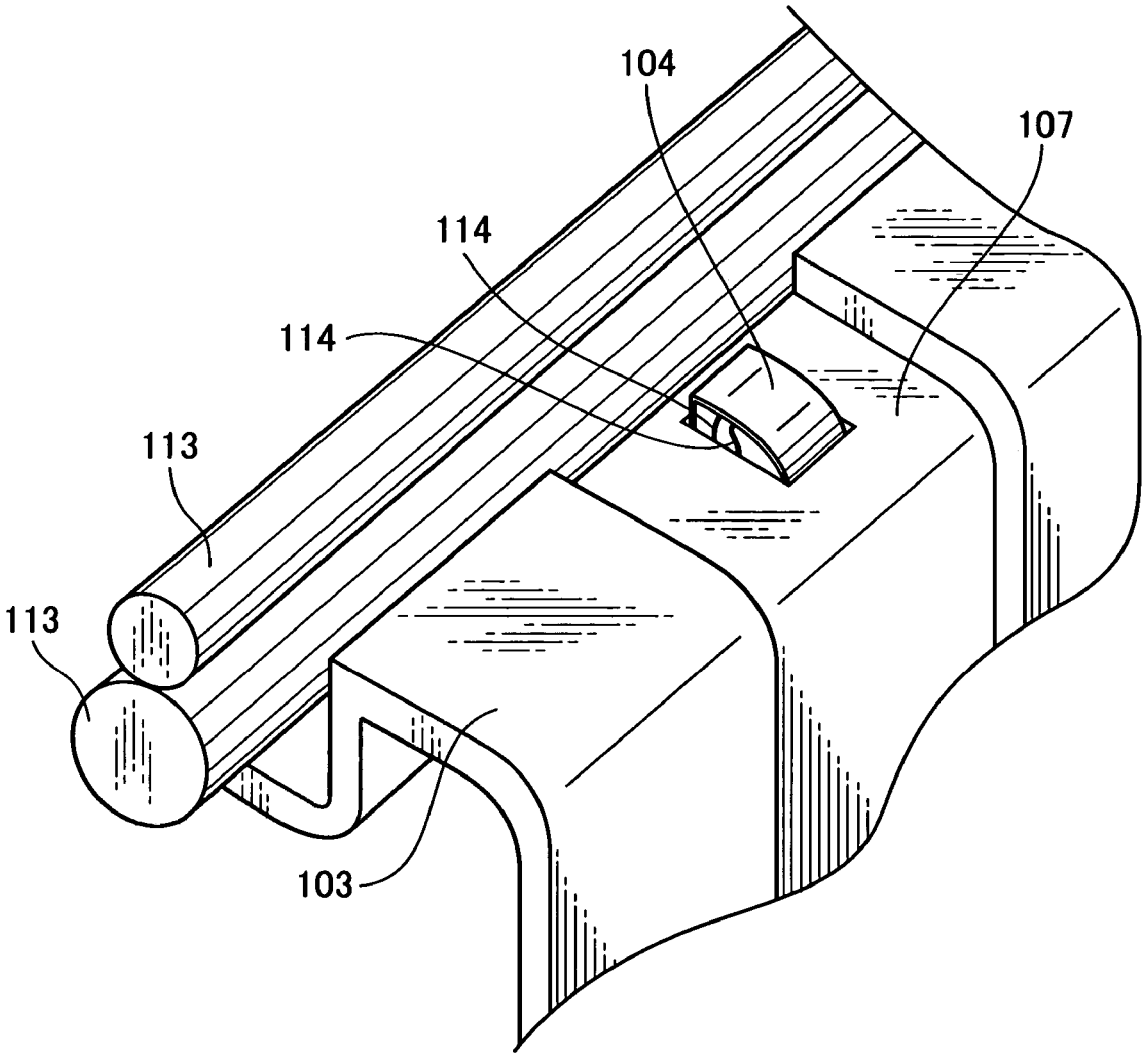
FIG. 2 is a perspective view showing components in the vicinity of a temperature sensing part for a recording material according to a second embodiment of the present invention.

A second embodiment will be described with reference to FIG. 2. In this embodiment, the surface geometries of the fixing/delivery guide 103 are altered so that the vicinity of the heat collector plate 104 will be separated as far as possible from the recording material being conveyed. This makes is possible to sense temperature with a higher degree of accuracy. FIG. 2 is a perspective view of a fixing/delivery guide 103 having a step height to make the vicinity of the heat collector plate 104 apart from both sides of the paper guiding surface of the fixing/delivery guide 103. In this embodiment, a step height 107 is formed to prevent the influence of heat from any components other than the heat collector plate 104 on the temperature of the heat collector plate 104 and the temperature of the recording material in the vicinity of the heat collector plate 104.

The recording material is brought into contact with the heat collector plate 104 in such a local area, further improving temperature sensor responsiveness. Like in the first embodiment, this embodiment has no opposed member on the opposite side of the heat collector plate 104. In this regard, this embodiment also has excellent temperature sensing accuracy, compared to the conventional examples in which there is an opposed member such as a roller cooperating with the temperature sensor to nip and feed the recording material.

There is a structural problem not only in this embodiment but also in the first embodiment and the other embodiments to be described later. When both-sided printing is performed on an image forming apparatus having a both-sided printing function, since the heat collector plate 104 comes into contact with a toner image on the first side of the recording material at the time of printing of the second side, there is apprehension that toner will adhere to the surface of the heat collector plate 104. To avoid this, the surface of the heat collector plate 104 may be coated with Teflon™, or UV coating may be applied to the surface of the heat collector plate 104 to such an extend that it does not affect the heat conductivity of the heat collector plate 104. The surface of the heat collector plate 104 may also be coated with PI (polyimide).

(Third Embodiment)

Figure 3:
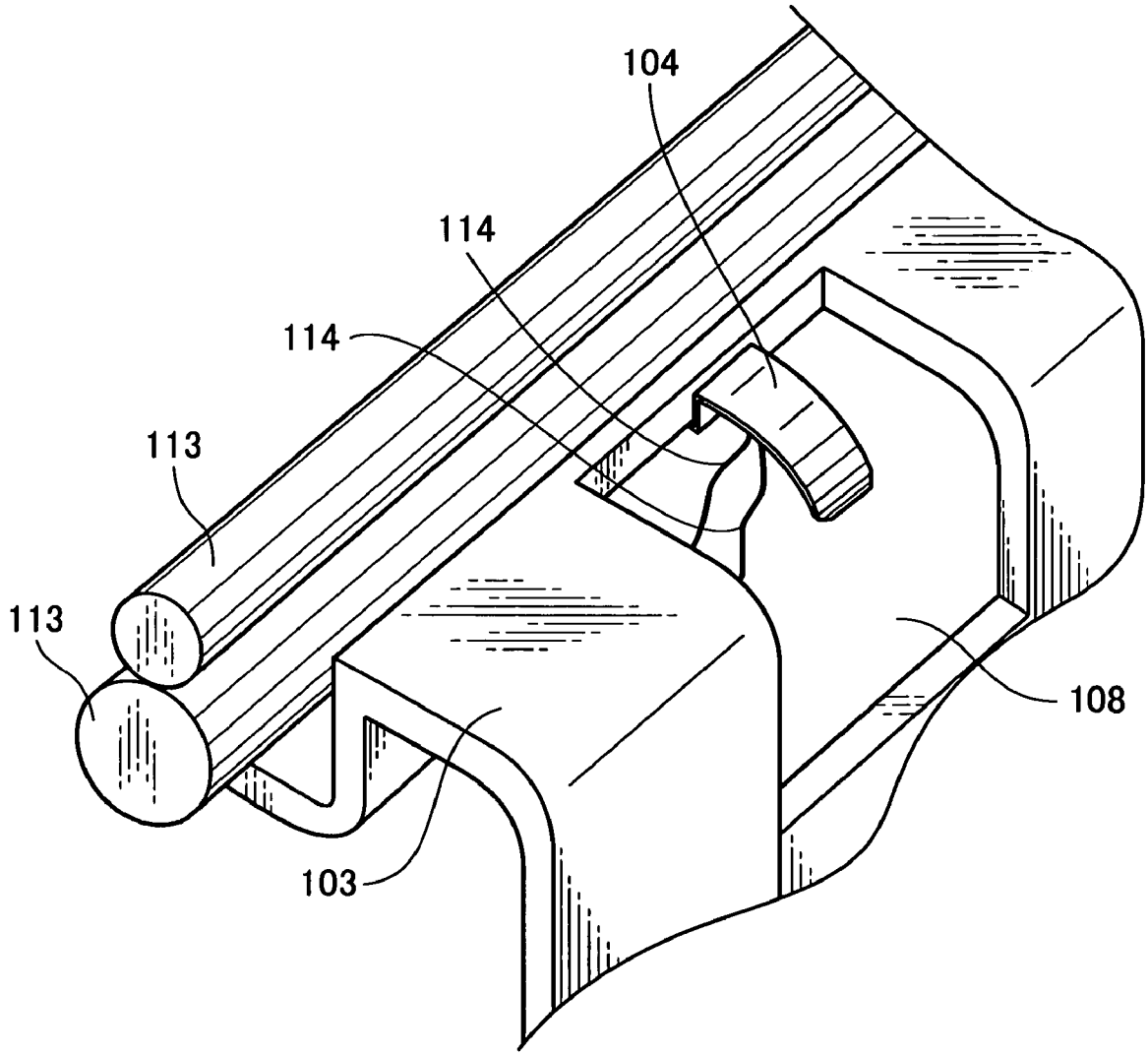
FIG. 3 is a perspective view showing components in the vicinity of a temperature sensing part for a recording material according to a third embodiment of the present invention.

A third embodiment will be described with reference to FIG. 3. FIG. 3 is a perspective view of a fixing/delivery guide 103 having a rectangular depressed portion in the vicinity of the heat collector plate 104. In this embodiment, a rectangular depressed portion 108 is provided to prevent the influence of heat from any components other than the heat collector plate 104 on the temperature of the heat collector plate 104 and the temperature of the recording material in the vicinity of the heat collector plate 104.

(Fourth Embodiment)

Figure 4:
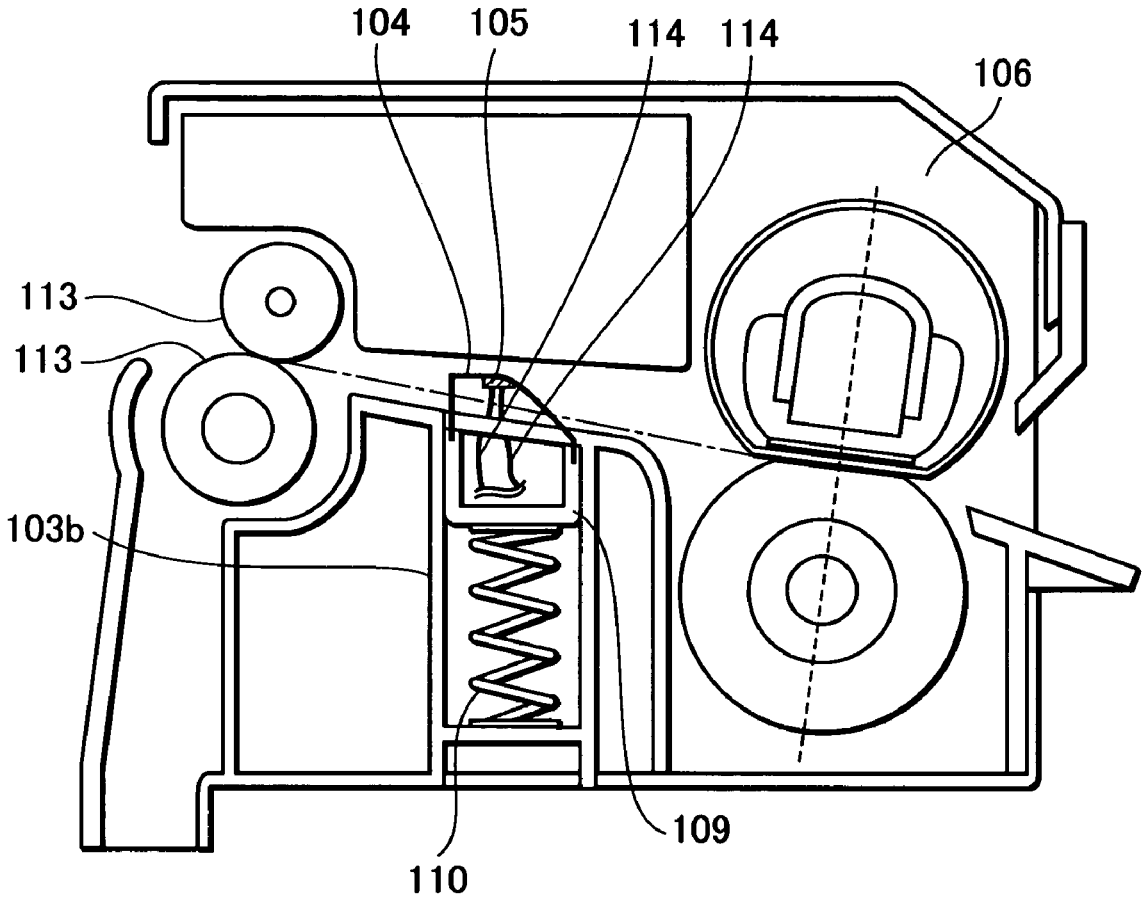
FIG. 4 is a cross sectional view showing components in the vicinity of a temperature sensing part for a recording material according to a fourth embodiment of the present invention, in which no recording material passes through the temperature sensing part.
Figure 5:
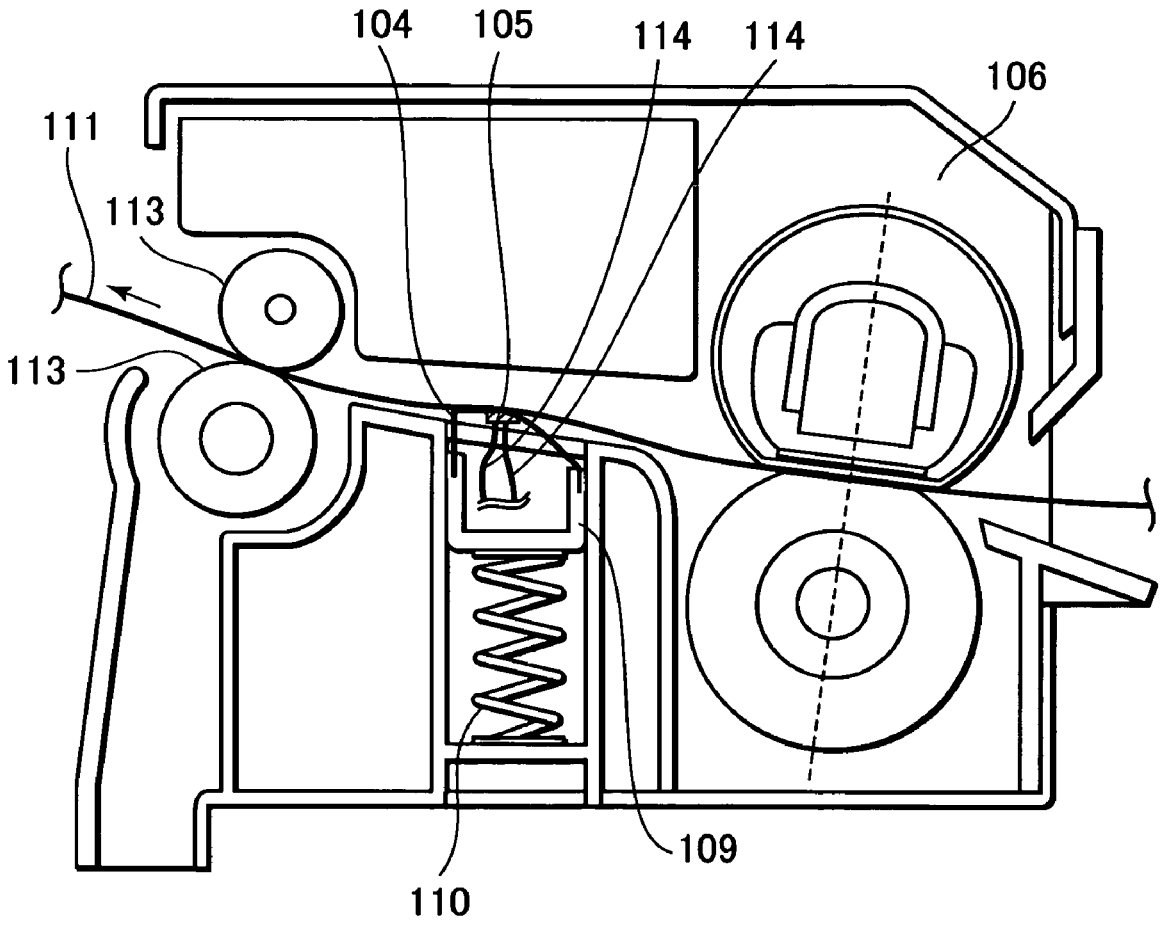
FIG. 5 is a cross sectional view showing the components in the vicinity of the temperature sensing part for a recording material according to the fourth embodiment of the present invention, in which a recording material is passing through the temperature sensing part.

A fourth embodiment will next be described with reference to FIGS. 4 and 5.

As mentioned above, the conveyance speed of the recording material between the delivery roller pair 113 is set higher than that in the fixing nip area. Therefore, the friction resistance of the heat collector plate 104 to the recording material may become large enough to damage the recording material depending on the speed setting or the kind of recording material. To avoid this, this embodiment illustrates an example of a structure for retracting the heat collector plate 104 attached to the fixing/delivery guide 103 when it receives a force from the recording material. FIG. 4 shows a home position and FIG. 5 shows a temperature sensing position. In FIG. 4, the heat collector plate 104 is formed integrally with a slide member (moving member) 109, which can move up and down along a slide guide part 103*b* of the fixing delivery guide 103. The slide member 109 is always forced upward by means of a spring 110, and the heat collector plate 104 is retained by a stopper (not shown) in a position as shown in FIG. 4. Then, as shown in FIG. 5, when the heat collector plate 104 is pressed down by a recording material 111, the heat collector plate 104 is retracted downward against the force of the spring 110. This makes it possible to reduce the friction resistance of the heat collector plate 104 to the recording material 111. Also in this embodiment, the temperature sensing part of the temperature sensing means is located on the opposite side of the recording material guiding member relative to the virtual straight line connecting the fixing nip area of the fusing means and the nip area of the conveyance means at least before the front edge of the recording material exits from the fixing nip area. This improves temperature sensing accuracy.

(Fifth Embodiment)

A fifth embodiment will next be described with reference to FIGS. 6 and 7.

Figure 6:
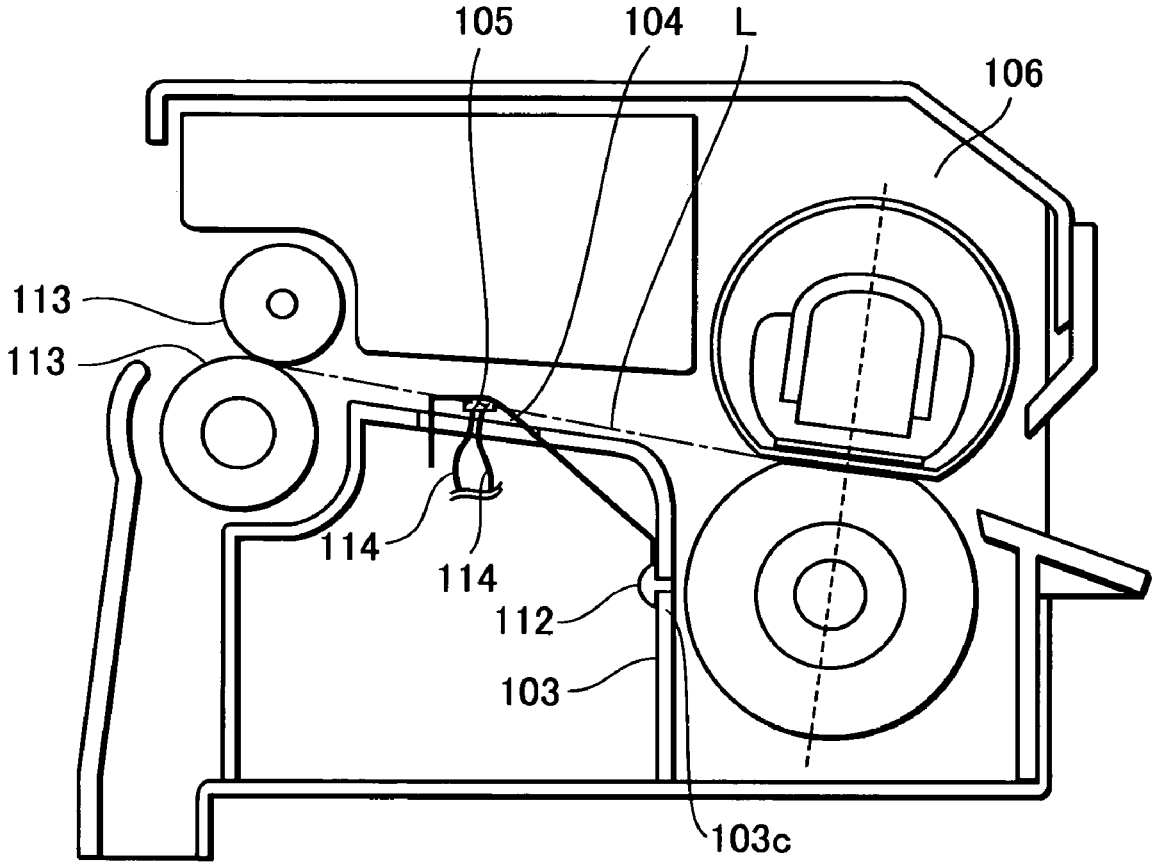
FIG. 6 is a cross sectional view showing components in the vicinity of a temperature sensing part for a recording material according to a fifth embodiment of the present invention, in which no recording material passes through the temperature sensing part.
Figure 7:
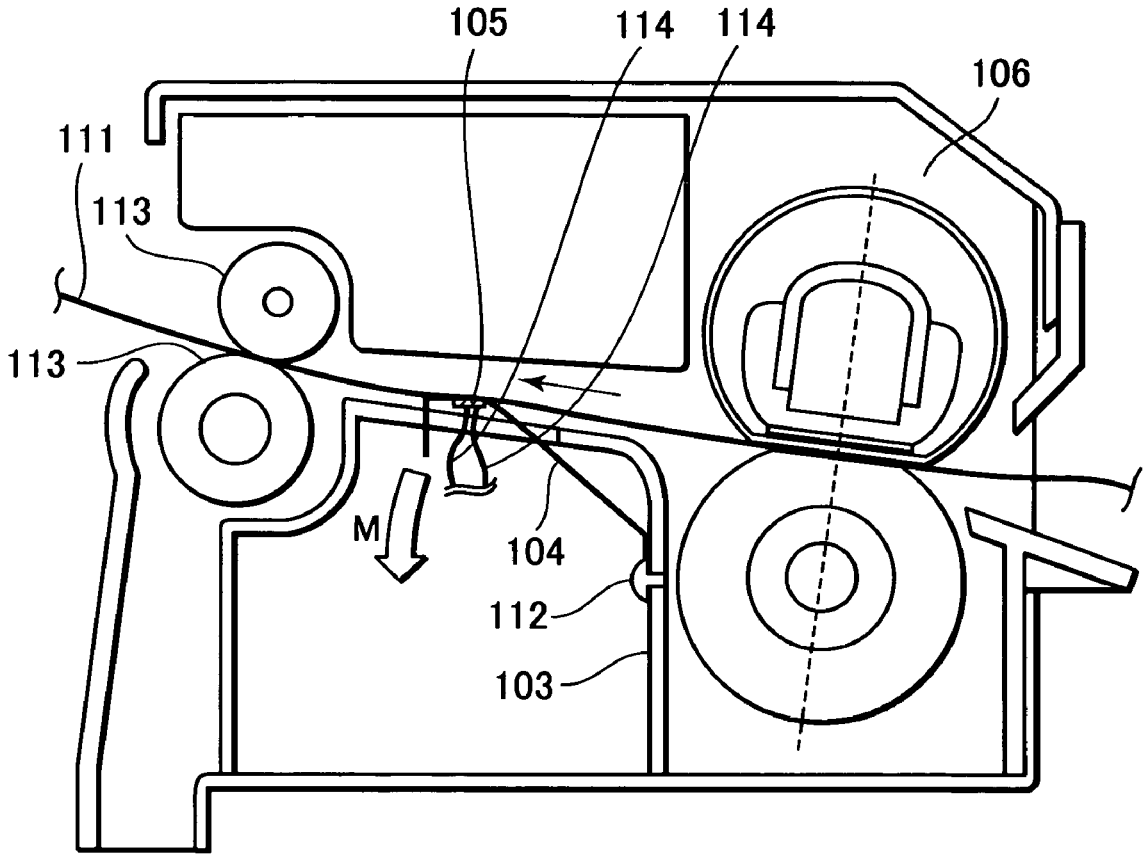
FIG. 7 is a cross sectional view showing the components in the vicinity of the temperature sensing part for a recording material according to the fifth embodiment of the present invention, in which a recording material is passing through the temperature sensing part.

FIGS. 6 and 7 illustrate another example of the structure for retracting the heat collector plate 104 attached to the fixing/delivery guide 103 when it receives a force from the recording material. FIG. 6 shows a home position and FIG. 7 shows a temperature sensing position. In FIG. 6, the heat collector plate 104 is fixed by a mounting member 112 at one end to a heat collector plate mounting part 103*c* of the fixing/delivery guide 103. Then, as shown in FIG. 7, when the heat collector plate 104 is pressed down by the recording material 111, the heat collector plate 104 turns in the direction of arrow M due to its spring properties, thus making the heat collector plate 104 retractable. In this embodiment, the heat collector plate 104 itself also serves as a moving member. This structure also makes it possible to reduce the friction resistance of the heat collector plate 104 to the recording material 111.

(Sixth Embodiment)

A sixth embodiment will next be described with reference to FIGS. 11 to 15. Members having the same functions as those in the above-mentioned embodiments are given the same reference numerals.

A fixing/delivery guide 28 is provided between the fixing nip area N and the nip area of the delivery roller pair (conveyance means). The fixing/delivery guide 28 forms a conveyance path for a recording-material. The fixing/delivery guide is made of a material having high heat resistance such as PBT or PET. The conveyance surface of the fixing/delivery guide is arranged below a virtual straight line A (see FIG. 13) connecting the fixing nip area and the delivery roller nip area. The conveyance speed of the recording-material between the delivery roller pair is set higher than that in the fixing nip area N. In other words, when the recording material is conveyed while being nipped in both the fixing nip area and the delivery roller nip area, the recording material travels without being in direct contact with the conveyance surface of the fixing/delivery guide.

Figure 11:
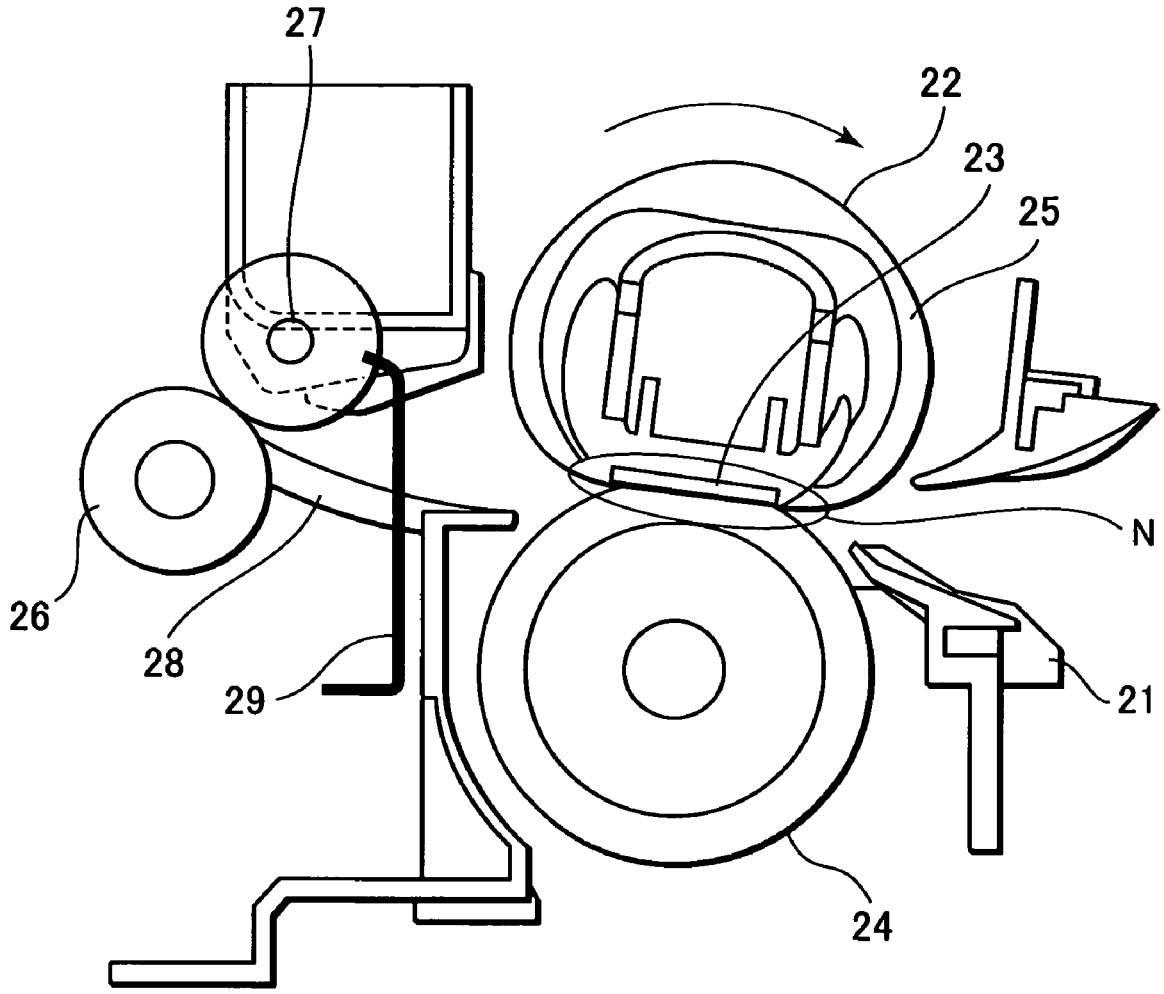
FIG. 11 is a cross sectional view showing components in the vicinity of a temperature sensing part for a recording material according to a sixth embodiment of the present invention, in which no recording material passes through the temperature sensing part.

The fixing/delivery guide 28 is provided with a moving member 29 one end of which is fixed to the apparatus main body. When coming into contact with the recording material, the moving member is bent by the pressing force of the recording material (FIG. 12), while when not being in contact with the recording material, it is at the home position (FIG. 11). The moving member is made from a thin aluminum or stainless steel plate of about 0.1 mm thick having spring properties and low heat capacity.

A heat collector plate 31 of the moving member 29 is so arranged that when the moving member 29 is at the home position, the heat collector plate 31 is seated above the virtual straight line A connecting the fixing nip and the delivery roller nip, while when the recording material passes, it comes into a direct contact with the recording material. In other words, the temperature sensing part of the temperature sensing means is located on the opposite side of the recording material guiding member relative to the virtual straight line connecting the fixing nip area of the fusing means and the nip area of the conveyance means at least before the front edge of the recording material exits from the fixing nip area. Thus, since the heat collector plate has low heat capacity and is brought into direct contact with the recording material, the temperature of the heat collector plate can be made almost equal to the temperature of the recording material in a short time.

When both-sided printing is performed, since the moving member comes into contact with a toner image on the first side of the recording material at the time of printing of the second side, there is apprehension that toner will adhere to the surface of the heat collector plate. To avoid this, the surface of the heat collector plate may be coated with Teflon™, or UV coating may be applied to the surface of the heat collector plate to such an extend that it does not affect the heat conductivity of the heat collector plate. The surface of the heat collector plate may also be coated with PI (polyimide).

Figure 14:
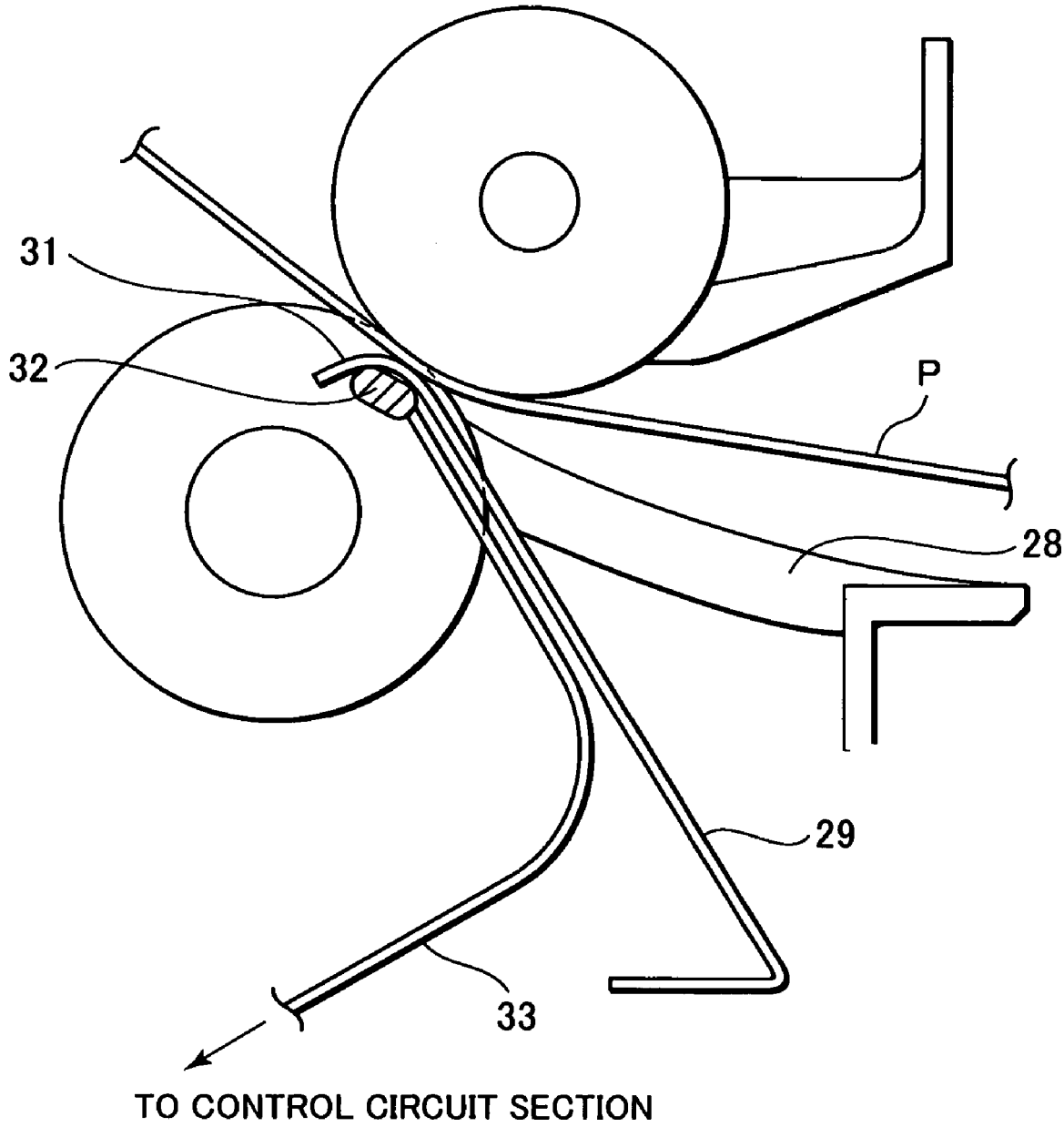
FIG. 14 is a cross sectional view showing a state of sensing the temperature of a recording material according to the sixth embodiment of the present invention.

A highly responsive temperature sensor 32 such as a thermistor is attached on the backside of the tip of the heat collector plate 31, for example, by adhesive bonding (FIG. 14). When the recording material after fusing is conveyed from the fusing device, since the recording material strikes the moving member to bend the moving member, the non-printed side of the recording material comes into contact with the heat collector plate, causing the heat collector plate to draw heat from the recording material. At this moment, the heat is transmitted to the temperature sensor on the backside to allow the temperature sensor to detect the temperature of the recording material. In this case, since the temperature sensor is mounted directly underneath the position in which the heat collector plate contacts the recording material, the influence of the temperature gradient in the heat collector plate can be minimized to increase the accuracy of sensing the temperature of the recording material. In addition, use of a metal material for a slide part of the moving member over which the recording material slides makes it possible to prevent the slide part from being worn away, and hence to improve durability.

The thermistor (the temperature sensor) is an element which varies its resistance with temperature; it is encapsulated in glass in such a state that dumet wires 33 are thermally bonded to a thermistor chip to connect electrodes. The other ends of the dumet wires are connected to a control circuit section so that temperature information detected by the thermistor will be transmitted to the control circuit section.

Figure 12:
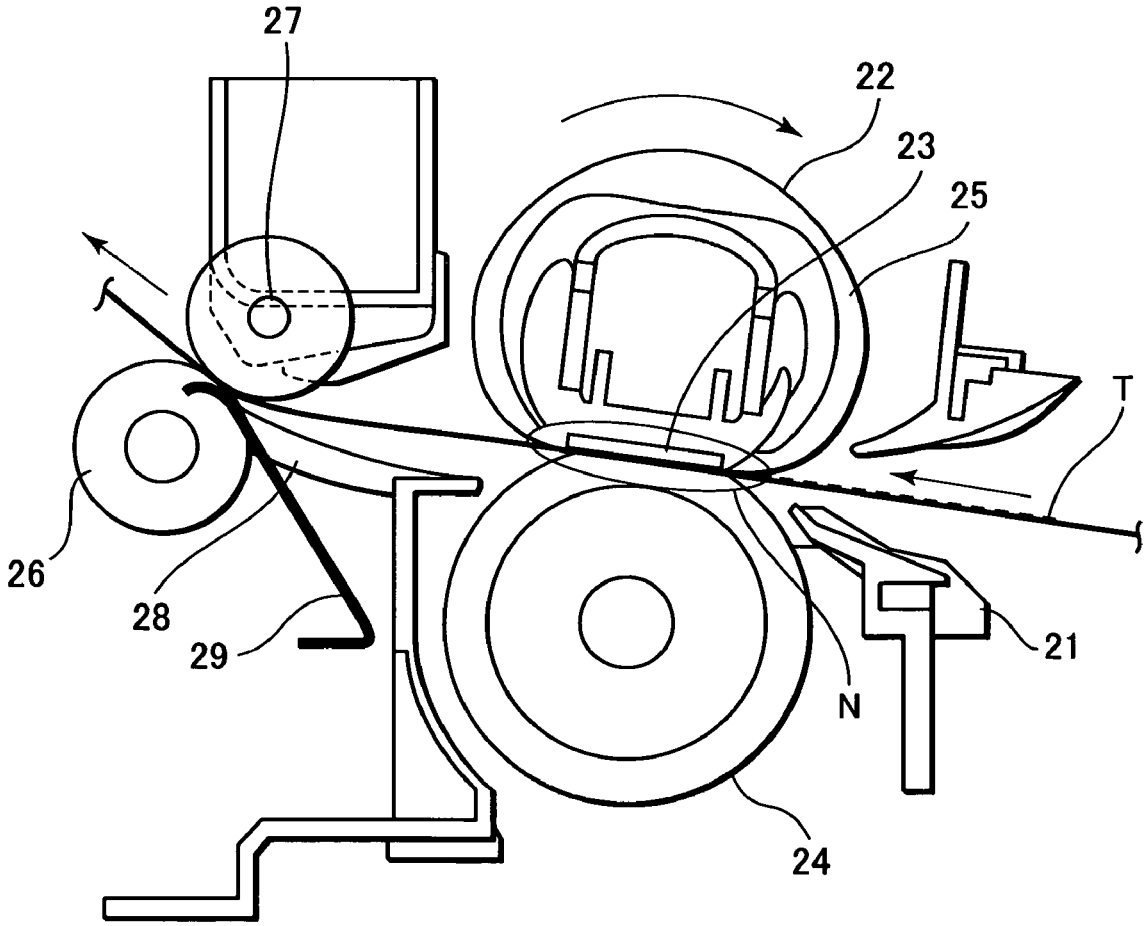
FIG. 12 is a cross sectional view showing the components in the vicinity of the temperature sensing part for a recording material according to the sixth embodiment of the present invention, in which a recording material is passing through the temperature sensing part.
Figure 13:
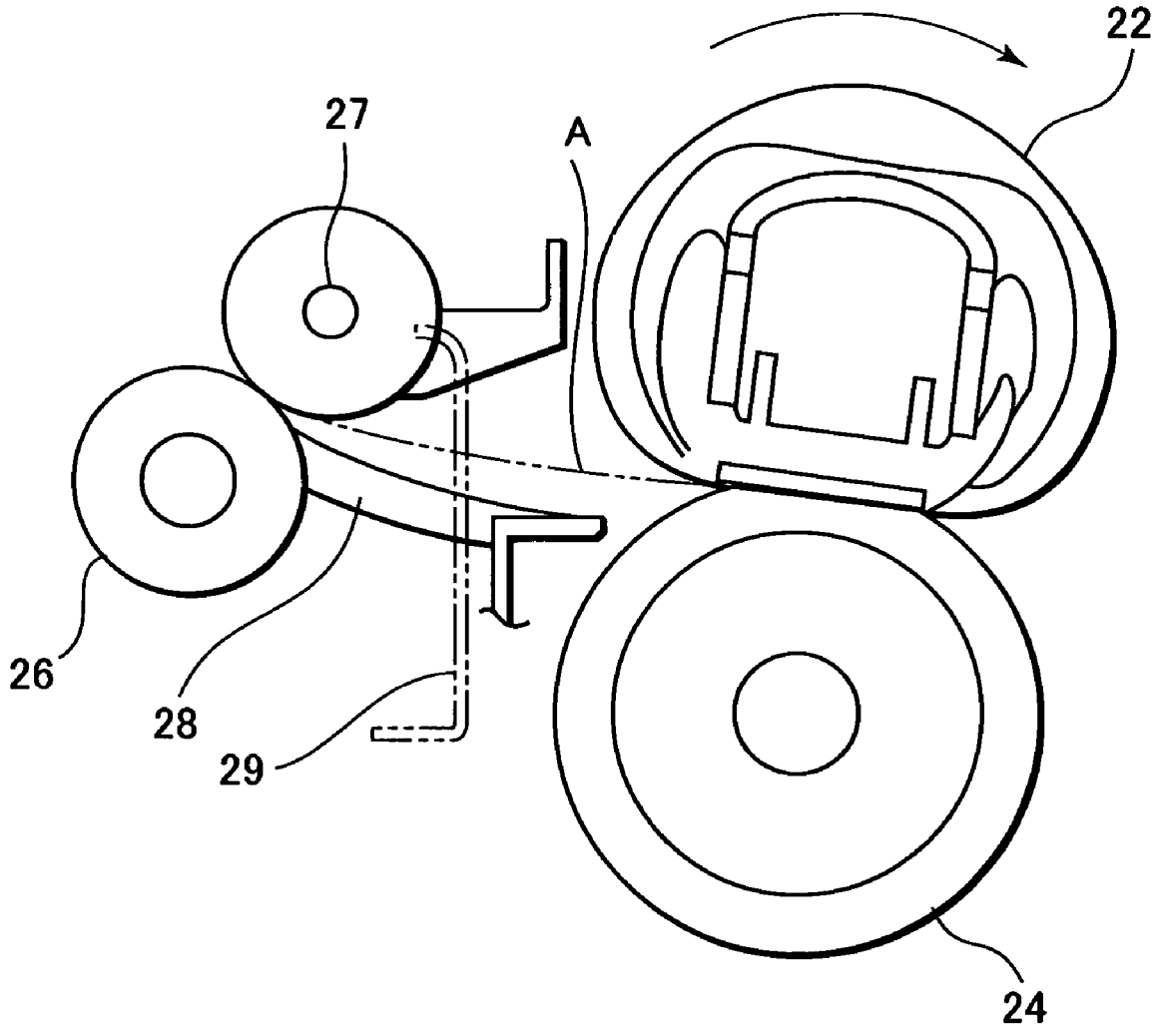
FIG. 13 is a cross sectional view showing the position of a recording material conveying guide and a virtual line connecting a fixing nip area and a nip area between delivery rollers according to the sixth embodiment of the present invention.
Figure 15:
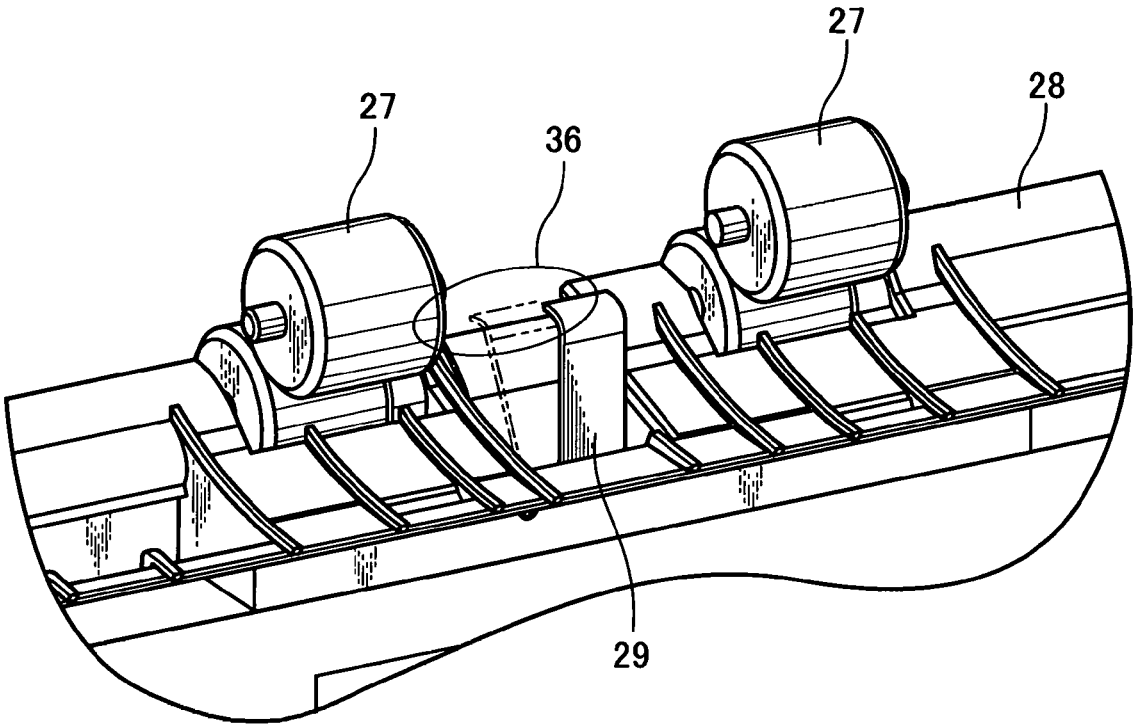
FIG. 15 is a perspective view of the components in the vicinity of the temperature sensing part for a recording material according to the sixth embodiment of the present invention.

The vicinity of the moving member will be further described with reference to FIG. 15. A delivery roller pair (conveyance means) has a delivery rubber roller 26 driven by a driving motor to rotate, and a delivery roller 27 driven by the rotation of the delivery rubber roller 26. The fixing/delivery guide 28 has a large clearance 36 in such a position that the moving member 29 turns to prevent the recording material from coming into contact with the paper guiding surface of the fixing/delivery guide in the vicinity of the area where the moving member comes into contact with the recording material. This makes it difficult for heat in the vicinity of the heat collector part to escape to the fixing/delivery guide, increasing the accuracy of sensing the temperature of the recording material. Further, as shown in FIGS. 12 and 14, the temperature sensing part of the moving member is set in such a manner that when the recording material is pushing down the moving member (temperature sensing position), the temperature sensing part comes to almost the same position as the nip position between the delivery rubber roller 26 and the driven delivery roller 27 in the passing direction of the recording material. In such a structure, when the moving member 29 is at the temperature sensing position, the position of the moving member 29 to force the recording material comes to almost the same position as the nip position between the delivery rubber roller 26 and the driven delivery roller 27 in the conveyance direction of the recording material, thereby preventing the recording material from being distorted by the force of the moving member 29. Thus, the prevention of distortion of the recording material can result in preventing the recording material from getting loosened from the temperature sensing part. This structure is effective in improving temperature sensing accuracy.

(Seventh Embodiment)

Figure 16:
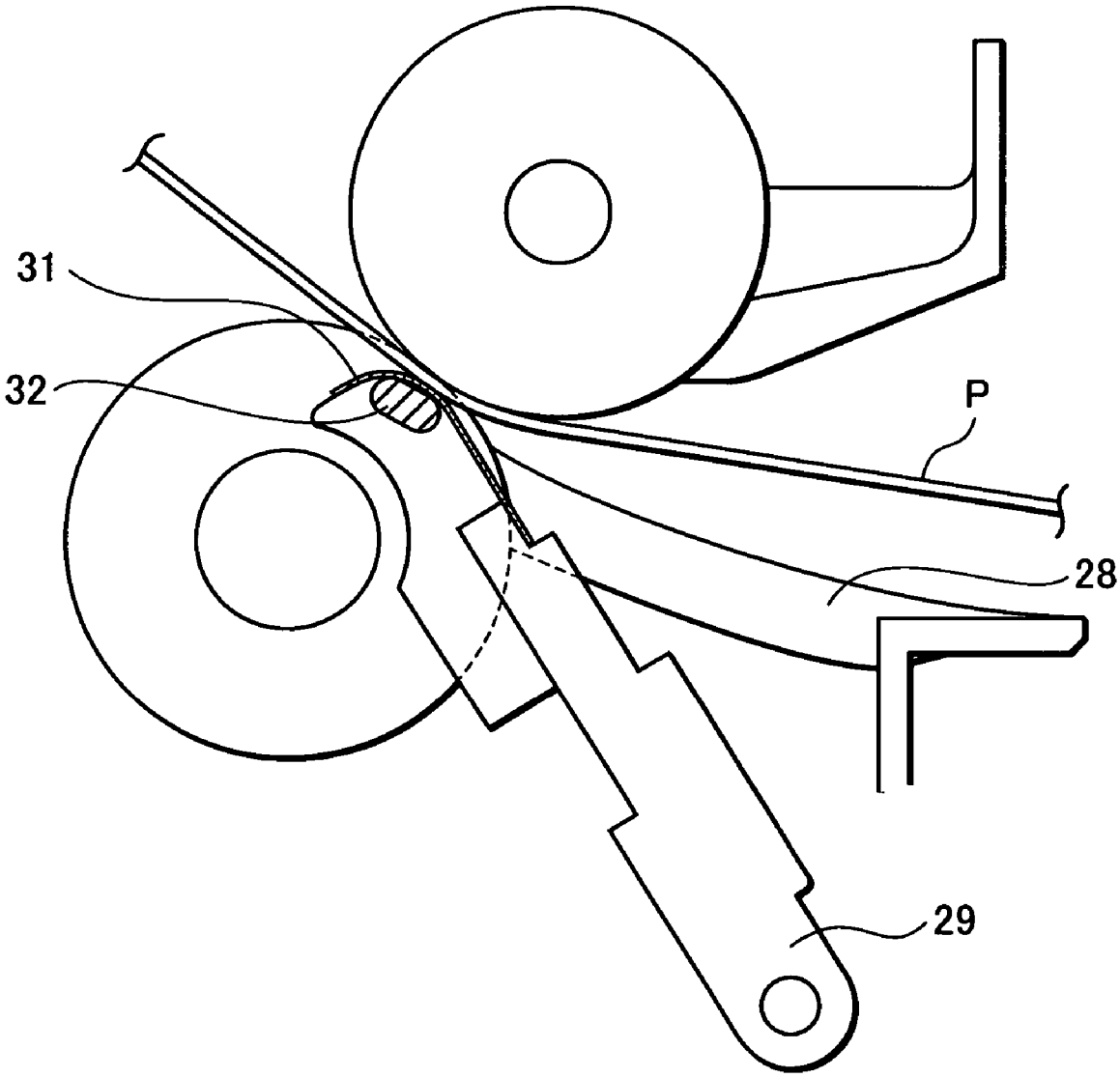
FIG. 16 is a cross sectional view showing a state of sensing the temperature of a recording material according to a seventh embodiment of the present invention.
Figure 17:
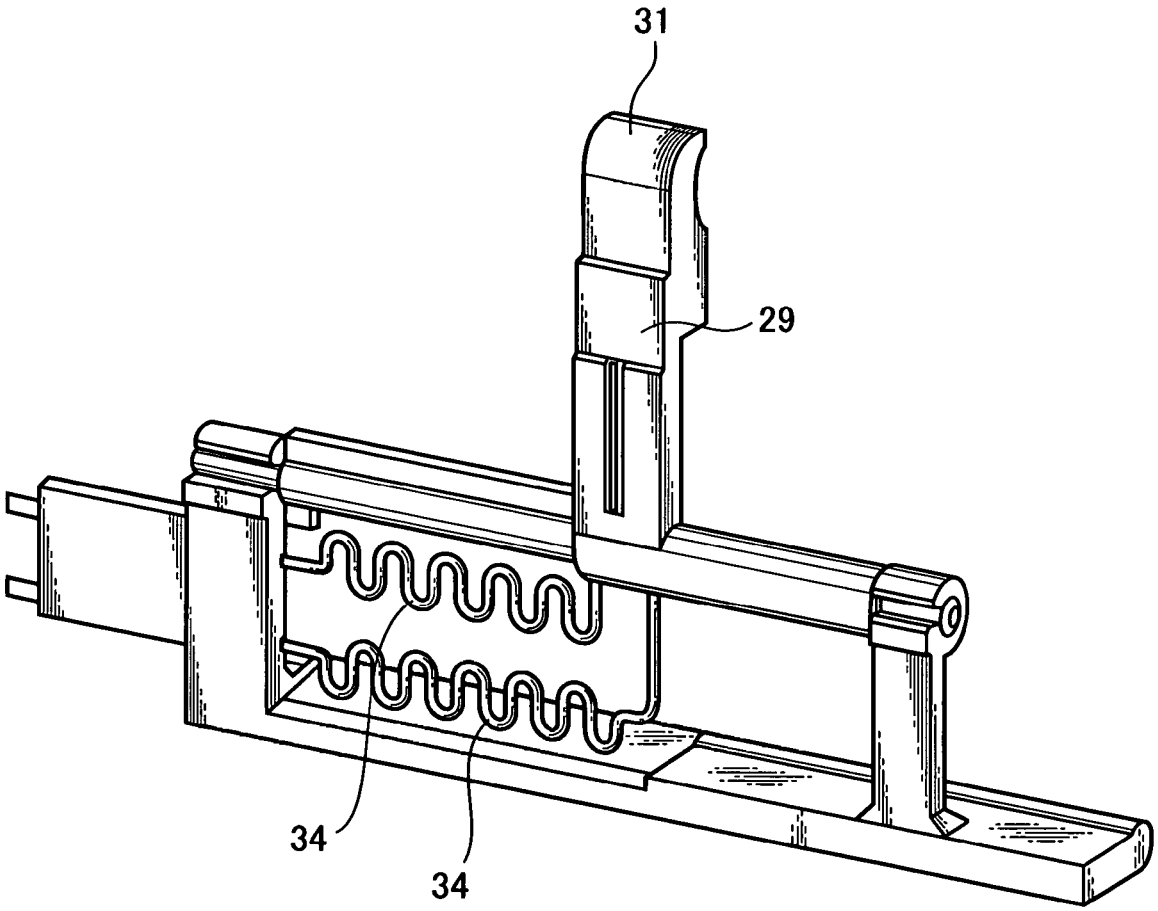
FIG. 17 is a perspective view of temperature sensing means, as seen from the upstream side of the recording material conveying direction, according to the seventh embodiment of the present invention.
Figure 18:
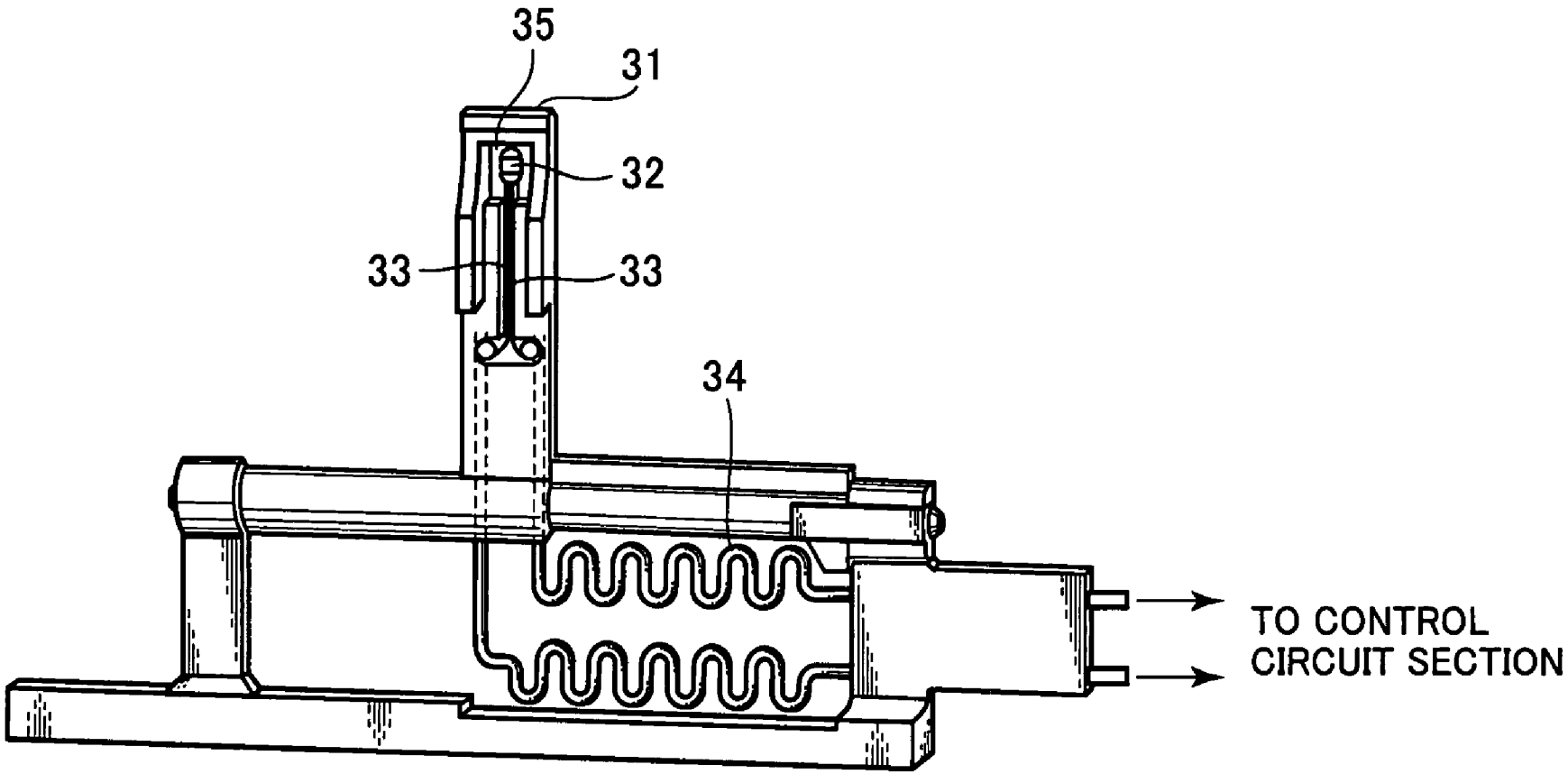
FIG. 18 is a perspective view of the temperature sensing means, as seen from the downstream side of the recording material conveying direction, according to the seventh embodiment of the present invention.
Figure 19:
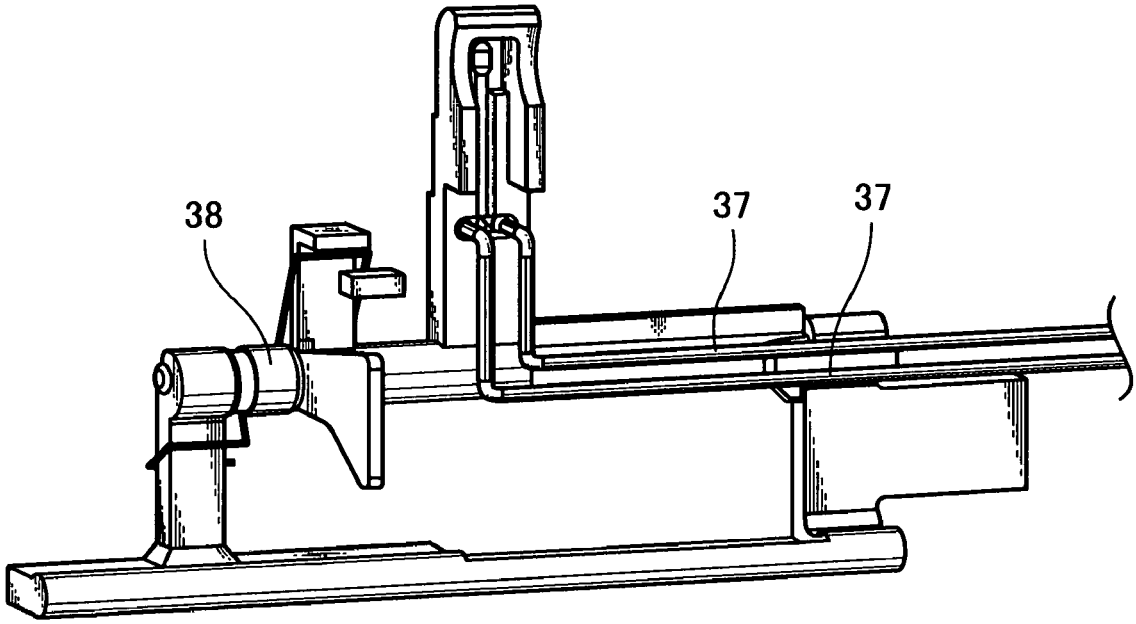
FIG. 19 is a perspective view of temperature sensing means, as seen from the downstream side of the recording material conveying direction, according to an eighth embodiment of the present invention.

FIG. 16 is a cross sectional view showing components in the vicinity of a temperature sensing part for a recording material in the image forming apparatus according to a seventh embodiment of the present invention. FIG. 17 is a perspective view of a moving member as seen from the upstream side of the moving direction of the recording material. FIG. 18 is a perspective view of the moving member as seen from the downstream side of the moving direction of the recording material. The following describes only the features of this embodiment. Since the other components are the same as those in the sixth embodiment, the description thereof will be omitted.

A moving member 29 of the embodiment is made up by integrating a heat collector plate 31, which is a thin plate of about 0.1 mm thick (made of aluminum or stainless steel with low heat capacity), into a plastic substrate by outsert molding or the like. As will be described later, thermistor electrodes 34 are also molded integrally with the moving member 29. The electrodes 34 serve to force the moving member to move from the temperature sensing position to the home position.

Like in the fourth to sixth embodiments, when the moving member 29 is at the home position, the heat collector plate 31 is seated above the virtual straight line connecting the fixing nip area and the delivery roller nip area. The front edge of the recording material that has passed through the fixing nip area comes first into contact with the plastic part of the moving member. Then the recording material progresses toward the downstream side and pushes the moving member to turn, bringing the heat collector plate 31 into contact with the non-printed side of the recording material. Thus, since the heat collector plate has low heat capacity and is brought into contact with the recording material, the temperature of the heat collector plate can be made almost equal to the temperature of the recording material in a short time. In order to reduce the heat capacity of the heat collector plate, it is preferable to minimize the dimensions of the heat collector plate both in the conveyance direction of the recording material and in a direction orthogonal to the conveyance direction and nearly parallel to the width of the recording material. Further, like in the sixth embodiment, the temperature sensing part of the moving member 29 is set in such a manner that when the recording material is pushing down the moving member (temperature sensing position), the temperature sensing part comes to almost the same position as the nip position between the delivery rubber roller and the driven delivery roller in the passing direction of the recording material. In such a structure, when the moving member 29 is at the temperature sensing position, the position of the moving member 29 to force the recording material comes to almost the same position as the nip position between the delivery rubber roller and the driven delivery roller in the conveyance direction of the recording material, thereby preventing the recording material from being distorted by the force of the moving member 29. Thus, the prevention of distortion of the recording material can result in preventing the recording material from getting loosened from the temperature sensing part. This structure is effective in improving temperature sensing accuracy.

A highly responsive temperature sensor 32 such as a thermistor is attached on the backside of the tip of the heat collector plate 31, for example, by adhesive bonding. When the recording material after fusing is conveyed from the fusing device, since the recording material pushes the moving member to turn, the heat collector plate 31 comes into contact with the non-printed side of the recording material P, causing the heat collector plate to draw heat from the recording material. At this moment, the heat is transmitted to the temperature sensor 32 on the backside to allow the temperature sensor 32 to detect the temperature of the recording material. In this case, since the temperature sensor is mounted directly underneath the position in which the heat collector plate contacts the recording material when the moving member turns (to the temperature sensing position), the influence of the temperature gradient in the heat collector plate can be minimized to increase the accuracy of sensing the temperature of the recording material. In addition, the use of the metal material for a slide part of the moving member over which the recording material slides makes it possible to prevent the slide part from being worn away, and hence to improve durability.

The thermistor is an element which varies its resistance with temperature; it is encapsulated in glass in such a state that dumet wires 33 are thermally bonded to a thermistor chip to connect electrodes. As mentioned above, the moving member 29 is made up by integrating the two electrodes 34, made of metal such as stainless steel, into the plastic part by outsert molding or the like (FIGS. 17 and 18). The dumet wires 33 are welded to the two electrodes 34, respectively. These electrodes 34 are then connected to the control circuit section so that temperature information detected by the thermistor will be transmitted to the control circuit section.

The electrodes 34 are made from a thin sheet metal of about 0.1 mm such as a thin stainless steel plate. The electrodes 34 serve not only to transmit temperature information from the thermistor to the control circuit section, but also to force the moving member to move from the temperature sensing position to the home position. One end of each electrode 34 on the thermistor side is formed integrally with the plastic part of the moving member, and welded to the dumet wires 33 of the thermistor, with the other end connected to each terminal fixed to the fixing/delivery guide. When the moving member 29 turns from the home position toward the temperature sensing position, the electrodes 34 become twisted from their fixed terminal connection part as a pivotal point by the rotation of the moving member 29. Then, the twist deformation causes the moving member 29 to returns to the home position. Since the electrodes 34 give an adequate turning force to the moving member 29 while receiving repeated stress from the movement of the moving member 29, they take the shape of a crank as shown in FIGS. 17 and 18 to prevent the occurrence of permanent deformation or rupture.

The following describes the tip portion of the moving member in more detail. As mentioned above, the heat collector plate 31 made of a material with low heat capacity is formed integrally with the plastic member 29 having low heat conductivity. A hollow space 35 is provided on the backside of the heat collector plate except for junctions with the plastic member. In other words, the backside of the heat collector plate 31 is exposed as seen from the downstream side of the moving direction of the recording material. This reduces the heat capacity of the heat collector plate and the vicinity, and hence makes it difficult for heat to be sensed by the temperature sensor 32 to escape, increasing the responsiveness of the temperature sensor.

(Eighth Embodiment)

An eighth embodiment will be described with reference to FIG. 18. In this embodiment, the dumet wires of the thermistor are directly connected to lead wires 37. The lead wires are arranged along the rotating shaft of the moving member, and connected to the control circuit section so that temperature information detected by the thermistor will be transmitted to the control circuit section through the lead wires. A helical torsion spring 38 is used to force the moving member to turn.

Thus, in the embodiment, the helical torsion spring 38 is used to force the moving member to turn, and the lead wires for transmitting the output of the thermistor are arranged along the rotating shaft of the moving member. This makes it possible to realize a simple structure of a temperature sensor inexpensive enough to work with such a moving member that is operated relatively infrequently.

While the present invention has been described with reference to exemplary embodiments, it is to be understood that the invention is not limited to the above-mentioned embodiments, and that various modifications may be made within the technical scope of the invention.

This application claims priority from Japanese Patent Application No. 2004-054638 filed Feb. 27, 2004 and Japanese Patent Application No. 2004-115596 filed Apr. 9, 2004, which are hereby incorporated by reference herein.

What is claimed is:

1. An image forming apparatus comprising:

image forming means for forming an image on a recording material;

fusing means having a fixing nip area for nipping and conveying the recording material and provided for fusing an image onto the recording material;

a plurality of conveyance means located downstream of the fixing nip area in the moving direction of the recording material; and temperature sensing means for sensing the temperature of the recording material on the downstream side of the fixing nip area in the moving direction of the recording material, wherein a temperature sensing part of said temperature sensing means is arranged to come into contact with the surface opposite to the image surface of the recording material at the time of one-sided printing, and wherein the temperature sensing part comes into contact with the recording material in an interval between the fixing nip area and said conveyance means closest to the fixing nip area in the downstream side of the moving direction of the recording material among said plurality of conveyance means.

2. The apparatus according to claim 1, further comprising a recording material guiding member between said fusing means and said conveyance means closest to the fixing nip area, wherein the speed of said conveyance means to convey the recording material is set higher than that of said fusing means so that when the recording material si conveyed while being nipped by both said fusing means and said conveyance means, the recording material travels without being in direct contact with said recording material guiding member.

3. The apparatus according to claim 1, further comprising a recording material guiding member between said fusing means and said conveyance means closest to the fixing nip area, wherein the temperature sensing part of said temperature sensing means is located on the opposite side of said recording material guiding member relative to a virtual straight line connecting the fixing nip area of said fusing means and the nip area of said conveyance means at least before the front edge of the recording material exits from the fixing nip area.

4. The apparatus according to claim 1, wherein said temperature sensing means includes a moving member movable between a home position and a temperature sensing position for sensing the temperature of the recording material, and the temperature sensing part is provided on the moving member.

5. The apparatus according to claim 4, wherein the moving member moves from the home position to the temperature sensing position when the recording material strikes the moving member, while it returns to the home position when the recording material moves away therefrom.

6. The apparatus according to claim 5, wherein the moving member is movable in the direction perpendicular to the surface of the recording material.

7. The apparatus according to claim 5, wherein the moving member comes down in the moving direction of the recording material when the recording material strikes it.

8. The apparatus according to claim 5, wherein electrodes of the temperature sensing part of said temperature sensing means are attached to the moving member, and the electrodes serve to return the moving member to the home position.

9. The apparatus according to claim 7, further comprising a forcing member for forcing the moving member toward the home position, wherein electric wiring from the temperature sensing part is provided in the vicinity of the rotating shaft of the moving member.

10. The apparatus according to claim 4, further comprising conveyance means located downstream of the fixing nip area in the moving direction of the recording material and driven by a drive source to convey the recording material, wherein when the moving member moves to the temperature sensing position, the temperature sensing part comes to almost the same position as the nip area of said conveyance means in the moving direction of the recording material.

11. The apparatus according to claim 1, wherein a heat transmit plate is provided in the temperature sensing part, and a temperature sensing element is in contact with one side of the heat transmit plate opposite to the other side with which the recording material comes into contact.

12. The apparatus according to claim 11, wherein the heat transmit plate is made of metal.

13. The apparatus according to claim 11, wherein the heat transmit plate is attached to a resin base material.

14. The apparatus according to claim 1, wherein said fusing means forms the fixing nip area between a heating unit and a backup unit, and the heating unit is placed on the image side of the recording material at the time of one-sided printing.

15. The apparatus according to claim 1, wherein said apparatus sets a setting temperature of said fusing means according to the temperature sensed by said temperature sensing means.

16. The apparatus according to claim 14, wherein the heating unit includes a flexible sleeve and a heater that is in contact with the inner circumferential surface of the sleeve and is controlled to maintain at a setting temperature, while the backup unit includes a pressure roller that is in contact with the outer circumferential surface of the flexible sleeve to form the fixing nip area with the heater through the flexible sleeve, such that said apparatus sets the setting temperature of the heater according to the temperature sensed by said temperature sensing means.

* * * * *

UNITED STATES PATENT AND TRADEMARK OFFICE

CERTIFICATE OF CORRECTION

PATENT NO. : 7,215,899 B2
APPLICATION NO. : 11/062634
DATED : May 8, 2007
INVENTOR(S) : Eiichiro Kimizuka et al.

It is certified that error appears in the above-identified patent and that said Letters Patent is hereby corrected as shown below:

COLUMN 1
Line 22, "One of such techniques, there" should read --There--, and
"proposed a" should read --proposed on such--.
Line 66, "this also make" should read --this also makes--.

COLUMN 7
Line 60, "makes is possible" should read --makes it possible--.

COLUMN 8
Line 24, "an extend" should read --an extent--.

COLUMN 10
Line 10, "an extend" should read --an extent--.

COLUMN 12
Line 47, "to returns" should read --to return--.

COLUMN 13
Line 52, "si conveyed" should read --is conveyed--.

Signed and Sealed this

Twentieth Day of May, 2008

JON W. DUDAS
*Director of the United States Patent and Trademark Office*